US007393811B2

(12) United States Patent
Chervin

(10) Patent No.: US 7,393,811 B2
(45) Date of Patent: Jul. 1, 2008

(54) FABRIC INK SUPPORT MEDIA AND SUBLIMATION DECORATION PROCESS

(75) Inventor: Christophe Chervin, Neydens (FR)

(73) Assignee: E. I. du Pont de Nemours and Company, Wilmington, DE (US)

( * ) Notice: Subject to any disclaimer, the term of this patent is extended or adjusted under 35 U.S.C. 154(b) by 374 days.

(21) Appl. No.: 11/183,631

(22) Filed: Jul. 18, 2005

(65) Prior Publication Data

US 2006/0021163 A1 Feb. 2, 2006

Related U.S. Application Data

(60) Provisional application No. 60/591,563, filed on Jul. 27, 2004.

(51) Int. Cl.
*B41M 5/035* (2006.01)

(52) U.S. Cl. ..... 503/227; 8/471

(58) Field of Classification Search ..... None
See application file for complete search history.

(56) References Cited

U.S. PATENT DOCUMENTS

| | | | |
|---|---|---|---|
| 4,056,352 | A | 11/1977 | Mayer |
| 4,314,814 | A | 2/1982 | Deroode |
| 5,308,426 | A | 5/1994 | Claveau |
| 5,893,964 | A | 4/1999 | Claveau |
| 5,962,368 | A | 10/1999 | Poole |
| 2003/0102078 | A1 | 6/2003 | Dabrowski, Jr. et al. |

OTHER PUBLICATIONS

International Search Report for PCT/US2005/026684 dated Nov. 7, 2005.

*Primary Examiner*—Bruce H Hess

(57) ABSTRACT

A sublimation ink carrier media is provided comprising a textile fabric and a sublimation ink printed on the textile fabric in a pattern. The textile fabric has a first direction and a second direction that is substantially perpendicular the first direction wherein the textile fabric is extensible in the first direction and is substantially non-extensible is the second direction. A process for the decoration of a shaped article by ink sublimation is also provided using this textile fabric. The process can be practiced with a textile fabric that is a woven fabric or nonwoven fabric.

22 Claims, 1 Drawing Sheet

FABRIC INK SUPPORT MEDIA AND SUBLIMATION DECORATION PROCESS

CROSS REFERENCE TO RELATED APPLICATION

This application claims the benefit of U.S. Provisional Application No. 60/591,563 filed Jul. 27, 2004.

FIELD OF THE INVENTION

This invention relates to a process for the decoration of shaped objects by ink sublimation. The invention also relates to a sublimation ink carrier media for use in such a process. More specifically, the invention relates to an ink carrier media for use in a sublimation decoration process, which media does not stretch during the printing of sublimation ink on the ink carrier media, but which media is able to stretch over a shaped object when the printed sublimation ink is applied to the surface of a shaped object during sublimation decoration.

BACKGROUND OF THE INVENTION

Paper, plastic, glass and metal substrates and shaped objects have been decorated by transfer printing with a sublimation ink. According to this process, a sublimation ink is first applied to an ink carrier media such as a paper sheet. The ink carrier is held in contact against the surface of the object to be decorated by mechanical means such as a stretchable sheet. The ink carrier media and the surface of the object being decorated are heated to an elevated temperature such that the ink sublimes to a vapor phase that prints onto the surface being decorated. Sublimation inks are made with dispersed dyes such as azo dyes, nitroarylamine dyes or anthraquinone dyes, that when heated, sublime to a gaseous state without passing through a liquid or melt state. These gaseous ink vapors print the surface of the object being decorated.

A device for use in the sublimation printing of shaped objects is disclosed in U.S. Pat. No. 5,893,964 and includes a flexible membrane. An object to be decorated is surrounded with a printed sublimation ink carrier media and placed inside the flexible membrane which is then sealed and evacuated. The atmospheric air pressure outside the flexible membrane presses the ink carrier media against the object to be decorated. The object, ink carrier media, and flexible membrane are then heated to the sublimation temperature of the ink such that the ink sublimes to an ink vapor which prints the surface of the object being decorated.

Sublimation printing of a three dimensional shaped object using a paper ink carrier media has the disadvantage that the paper cannot properly conform to the shape of the surface being decorated. When a flat paper ink carrier is pressed against a three dimensional object, the paper crumples or creases, which causes discontinuities in the image printed on the object surface.

Attempts have been made to overcome this problem by using an ink carrier media that conforms to the surface of a three-dimensional surface being printed. U.S. Pat. No. 5,308,426 discloses ink support materials made of woven fabric, knitted fabric or non-woven material. Although sublimation ink support fabrics offer greater ability to conform to shaped objects than paper, they still exhibit a variety of drawbacks. Many fabrics, such as conventional woven and non-woven fabrics, are not sufficiently flexible and stretchable to be able to conform to the surface of a three dimensional shaped object. Such fabrics bunch or crumple when pressed against a shaped object being decorated in much the same way as occurs with a paper ink support media.

Knit fabrics have been used as a sublimation ink support carrier because they are more extensible than other fabrics and can therefore better conform to the shape of an object. While this extensibility is beneficial during the sublimation step, the same property makes it more difficult to print the sublimation ink onto the carrier media. In many printing processes, such as silk screen printing, heliographic printing and ink jet printing, each color of a design is printed separately, and if the carrier media being printed stretches or contracts between the printing of the various colors, the result is a blurred printed image on both the ink carrier media and the decorated object. In addition, with extensible knitted fabric sublimation ink carriers, when the fabric is stretched over a shaped object during sublimation printing, void spaces in the fabric open up which reduces the sharpness and clarity of the image that is sublimation printed. Along the same lines, extensible knitted fabrics have the property that they are quite porous, especially when stretched. This porosity allows the sublimed ink vapors to pass from the ink carrier media in both the direction of the object being decorated and in the direction of the surrounding flexible membrane such that the flexible membrane quickly becomes contaminated with sublimation inks unless an additional disposable protective sheet is inserted between the ink carrier media and the flexible membrane. Otherwise, during subsequent decorations, the sublimation inks deposited on the membrane can pass back through the porous ink carrier media and randomly deposit on the surface being decorated.

U.S. Pat. No. 5,962,368 disclose a sublimation ink carrier media comprised of a shrink wrap film that can be heated so as to conform to the shape of the object being printed. Shrinkable films have the disadvantage that they are difficult to conform to complex shapes. A further disadvantage of shrinkable films is that they often continue to shrink during the sublimation transfer step which tends to cause blurring of the decorated image. Finally, shrinkable films tend to be time consuming to remove after the sublimation step is complete.

As described above, there is a need for a sublimation ink carrier media that does not deform when it is being printed with a pattern or design, but that does extend during sublimation so as to conform to the shape of an object being decorated. There is a further need for a sublimation decoration process with a sublimation ink carrier media that can extend around and conform to the surface of a three dimensional object being decorated, but that does not open up when stretched such that the sublimated decoration loses clarity. Finally, there is a need for a flexible and extensible sublimation ink carrier media and sublimation decoration process wherein it is not necessary to insert a protective sheet between the ink carrier media and the surrounding flexible membrane so as to prevent contamination of the flexible membrane.

SUMMARY OF THE INVENTION

The invention provides a sublimation ink carrier media comprising a textile fabric, the fabric having a first direction and a second direction that is substantially perpendicular the first direction wherein the textile fabric is extensible in the first direction and is substantially non-extensible is the second direction, and a sublimation ink printed on the textile fabric in a pattern. According to one preferred embodiment of the invention, the textile fabric is a woven fabric having a first set of substantially parallel fibers oriented in said first direction and a second set of substantially parallel fibers oriented in a second direction that is substantially perpendicular said first direction wherein the first set of fibers are primarily extensible fibers and the second set of fiber are primarily non-extensible fibers. According to another embodiment of the invention, the textile fabric may be a non-isotropic non-woven.

The invention further provides a process for the decoration of a shaped article by ink sublimation. The process includes the steps of selecting a textile fabric having a first direction and a second direction that is substantially perpendicular the first direction wherein the textile fabric is extensible in the first direction and is substantially non-extensible is the second direction, feeding the textile fabric through a printing apparatus in a direction such that the second direction of the textile fabric is substantially parallel to direction that the textile fabric travels through the printing apparatus, printing a surface of the textile fabric with one or more sublimation inks in the printing apparatus, pressing the printed surface of the textile fabric against the surface of the object to be decorated such that the textile fabric is extended and conforms to the surface being decorated, and heating the ink printed on the textile fabric to a temperature sufficient to sublime the ink to a vapor and decorate the shaped object. The process can be practiced with a textile fabric that is a woven or nonwoven fabric.

TEST METHODS

Figure 1:
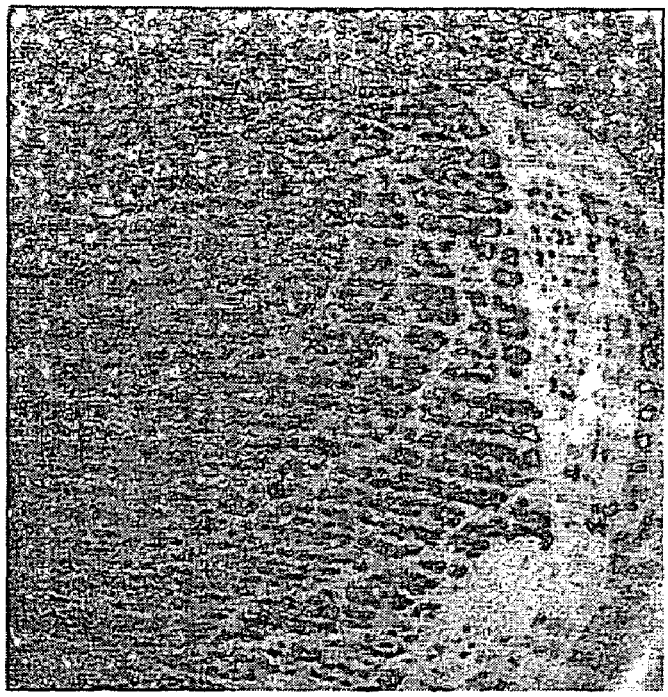
FIG. 1 is a photograph of a sublimated decoration printed with a sublimation ink carrier media according to the prior art.

In the description and in the non-limiting example that follows, the following test methods were employed to determine various reported characteristics and properties. ISO refers to the International Organization for Standardization.

Elongation was measured according to ISO 3376 and is expressed as a percent. The maximum elongation is the percent elongation to a 30 mm wide strip of fabric under an applied tensile force of 15N.

Fabric Porosity was measured using a light transmission method. A fabric to be measured was placed over a light box lit by a controlled light intensity. Photographs of the light passing through the fabrics were taken under various degrees of fabric deformation. The photographs were digitized and the light pixels and the dark pixels in the photograph were counted using a computer program. Pixels in areas of visually apparent light were characterized as light pixels. The pixels characterized as light pixels were counted and divided by the total number of pixels and then multiplied by 100 to determine a light transmission percent porosity.

DETAILED DESCRIPTION OF THE INVENTION

The invention provides a sublimation ink carrier media comprised of a textile fabric that is extensible in a first direction and is substantially non-extensible in a second direction that is substantially perpendicular to the first direction. By extensible, it is meant that the fabric can be deformed under the amount of tension that is typically applied to an ink carrier media when the media is conformed over the surface of a shaped object being decorated. By substantially non-extensible, it is meant that the fabric does not deform an appreciable amount under the amount of tension that is typically applied to an ink carrier media when the media is being drawn through a printing apparatus or printing process.

According to a preferred embodiment of the invention, the textile fabric is a woven fabric having a first set of substantially parallel fibers oriented in a first direction and a second set of substantially parallel fibers oriented in a second direction that is substantially perpendicular to the first direction. The first set of fibers are primarily extensible fibers and the second set of fibers are primarily non-extensible fibers. The fibers may be comprised of a natural or synthetic materials conventionally used for producing textile fibers. Examples of suitable materials for producing the woven fabric for the sublimation ink carrier media of the invention include polyester fibers, polyamide fibers, spandex fibers, elastomeric fibers, acetate fibers, viscose fibers, wool fibers, cotton fibers, and cellulose fibers. The preferred woven fabric of the ink carrier media of the invention is extensible in the first direction of the first set of fibers and is substantially non-extensible in the second direction of the second set of fibers. The elongation of the woven fabric in the first direction of said first set of fibers is preferably at least 10% at a tension of 0.1 N per $mm^2$, and is more preferably at least 20% at a tension of 0.1 N per $mm^2$, and is most preferably at least 30% at a tension of 0.1 N per $mm^2$. The elongation of the woven fabric in the second direction of said second set of fibers at a tension of 0.3 N per $mm^2$ is preferably less than 10%, and is more preferably less than 5%, and is most preferably less than 3%. In the woven fabric of the sublimation ink carrier media of the invention, the first direction of the first set of fibers is preferably the cross direction of the woven fabric, and the second direction of said second set of fibers is preferably the machine direction of the woven fabric. The machine direction of a fabric may also be referred to as the warp direction and the cross direction of a fabric is also referred to as the weft direction of the fabric.

According to a preferred embodiment of the invention, the first set of substantially parallel fibers of the woven fabric of the sublimation ink carrier media of the invention includes elastic fibers. By elastic, it is meant that the fibers extend when stretched under the amount of tension that is typically applied to an ink carrier media when the media is conformed over the surface of shaped object being decorated, and that the fibers substantially retract to their original dimension when the tension on the fabric is released as the fabric is removed from the object. In a preferred embodiment of the invention, the elastic fibers are composite covered fibers comprised of non-extensible acetate fibers wound around elastic spandex fibers such that the acetate fibers define the maximum degree of composite fiber stretch when pulled taunt.

According to the preferred embodiment of the invention, the sublimation ink carrier media does not become substantially more porous when it is stretched under the amount of tension that is typically applied to an ink carrier media when the media is conformed over the surface of a shaped object being decorated by ink sublimation. Preferably, the woven fabric of the sublimation ink carrier media of the invention has a light transmission porosity at 20% elongation of less than 3%. More preferably, the woven fabric has a light transmission porosity at 20% elongation of less than 1%.

The most preferred woven fabric for the sublimation ink carrier media of the invention is a satin fabric of 4 to 10. In a satin fabric of 5, the weft direction fibers pass over every fourth warp direction fiber and under the other warp direction fibers, and in a satin fabric of 10, the weft direction fibers pass over every ninth warp direction fiber and under the other warp direction fibers. In the preferred satin fabrics (satin fabric of 5), there is an offset of 2 or 3 such that the warp direction fiber over which a weft direction fiber passes is offset by two or three fibers from warp direction fiber over which the weft direction fiber of the preceding row passed.

According to an alternative embodiment of the invention, the fabric of the ink carrier media of the invention may be a nonwoven fabric. The preferred nonwoven is a non-isotropic fabric that is extensible in the first direction and is substantially non-extensible in the second direction that is substantially perpendicular to the first direction. The elongation of the nonwoven fabric in the first direction is preferably at least 10% at a tension of 0.1 N per $mm^2$, and is more preferably at least 20% at a tension of 0.1 N per $mm^2$, and is most preferably at least 30% at a tension of 0.1 N per $nm^2$. The elongation of the nonwoven fabric in the second direction at a tension of 0.3 N per $mm^2$ is preferably less than 10%, and is more preferably less than 5%, and is most preferably less than 3%. In nonwoven fabrics, differential elongation between the machine direction the cross direction is often inherent due to orientation of the fibers unless steps are taken to randomize the fiber orientation. A significant degree of fiber orientation can be obtained by monitoring the cross lapping of the carded batts that make up the web of the nonwoven fabric. When significant fiber orientation exists in a nonwoven fabric, the elongation in a first direction is often more than three times the elongation of the nonwoven fabric a second direction that is perpendicular to the first direction. Examples of such nonwoven fabrics include air-layed spunbonded nonwovens and spun-laced nonwovens that are thermally or chemically bonded. Such nonwoven fabrics are generally comprised of short length staple fibers having a length of 15 to 40 mm. One non-isotropic nonwoven that can be advantageously utilized as a sublimation ink carrier media according to the invention is a hydro-entangled nonwoven fabric made according to the process described in U.S. Pat. No. 3,485,706. One such fabric is a Softesse™ Style 8000 spunlaced fabric available from E.I du Pont de Nemours and Company, which has a basis weight of 41 $g/m^2$, an elongation in a first direction of 10% at a tension of 0.1 N per $mm^2$ and an elongation in the perpendicular second direction of 3.1% at a tension of 0.3 N per $mm^2$.

According to the invention, the process for the decoration of a shaped article by ink sublimation first comprises the steps of selecting a sublimation ink carrier textile fabric as described above. The textile fabric is fed through a printing apparatus or printing process in a direction such that the substantially non-extensible second direction of the fabric is substantially parallel to the direction that the fabric travels through the printing apparatus. The carrier media is typically heliographically printed using a rotogravure equipment and various color sublimation inks. Other printing processes can also be used such as flexography, screen printing, inkjet printing or offset printing.

In a heliographic printing process, the desired images are screened by tiny cells etched to produce tiny indentations on the surfaces of the printing cylinders. The indentations vary in depth and width and are below the non-printing areas of the roll surfaces. The printing cylinders rotate through a bath of ink and the non-printing areas are wiped clean by a doctor blade before the image is directly applied to a substrate to be printed. The inks are designed to print from depressed indentations like those found on gravure roll printing cylinders. The ink is very fluid such that it easily fills the thousands of tiny indentations on each of the printing cylinders, and at the same time the ink has enough body (viscosity) and adhesion to be pulled from the wells onto the surface being printed. The consistency of the ink must be maintained to permit the doctor blade to properly clean the plate and ensure a proper transfer of the printed image to the surface being printed. Gravure inks are quick-drying and are usually dried by evaporation in an oven at low temperature (max 40° C.).

The sublimation inks printed on the ink carrier fabric are heat activated inks that change directly to a gas phase when heated, which gas phase has the ability to bond to a surface being decorated. The sublimation inks used in heliographic printing are normally composed of dispersed dyes in alcohol or water. The dyes include one or more organic pigments that can sublimate directly to a gas phase. The dispersed dyes of sublimation inks are conventionally azo dyes, nitroarylamine dyes or anthraquinone dyes.

The printed textile fabric is next placed over and conformed to the surface of the object to be decorated. One sublimation apparatus that can be used is described in European No. EP 451 067. In this apparatus, the object to be decorated is first covered with the sublimation ink carrier media, and then inserted between two flexible membranes held by two articulated rigid frames. Another suitable sublimation apparatus is disclosed in U.S. Pat. No. 5,893,964 which consists of a sealed flexible membrane sack. With this device, an article to be decorated is surrounded by a sublimation ink carrier media and then placed inside the sealed membrane sack. The sack is then evacuated and heated to a pressure in the range of 0.6 to 1.0 bar such that the outside atmospheric pressure presses the sublimation ink carrier media against the surface being decorated. Finally, the printed sublimation ink on the woven fabric is heated to a temperature sufficient to sublime the ink to a vapor and decorate the shaped object. Typical sublimation temperatures are in the range of 150° C. to 215° C.

Materials that can be decorated using the sublimation ink carrier media of the invention and the ink sublimation decoration process of the invention include aluminum and other metals, wood, plastic, glass treated with an organic topcoat, and painted plastic or metal parts. Plastics that can be directly decorated according to the ink sublimation decoration process of the invention include polyesters, polyamides and polyacetal polymer resins.

EXAMPLES

The invention is further illustrated by the following examples. It will be appreciated that the examples are for illustrative purposes only and are not intended to limit the invention as described above. Modification of detail may be made without departing from the scope of the invention.

In the following example and comparative example, shaped polyacetal molded articles were decorated by ink sublimation using two different sublimation ink carrier media that had been identically printed. In Comparative Example 1, the carrier media was a knitted fabric, whereas in Example 2, the carrier media was a woven fabric ink carrier media according to the invention. In each example, the carrier media was heliographically printed according to the printing process discussed above with the same detailed pattern using rotogravure equipment and a black sublimation ink. The sublimation ink used was Black Subli 648 obtained from Sensient of Morges, Switzerland. This ink was composed of dispersed dyes in alcohol. Each fabric was printed at a speed of 60 m/min, with a drying temperature of 40° C.

The sublimation process and apparatus used was the process and apparatus described in European No. EP 451 067. The object to be decorated was placed under the printed ink carrier fabric, and then inserted between two flexible membranes held by two articulated rigid frames. In each example, the object decorated was an injection molded polyacetal article having a hollow wedge shape with a long side of 50 mm, a width 39 mm, and a depth 15 mm. The polyacetal used was Delrin® 511 P acetal polymer from DuPont of Wilmington, Del., U.S.A. The frames were closed such that the membrane pressed the ink carrier media against the shaped object being decorated. The entire apparatus was then passed through a continuous oven during which time a vacuum of 0.6 to 0.8 bars was applied between the flexible membranes. The oven had four 60 cm long zones and the frame passed through the zones at a speed of 75 cm/minute. The temperature profile of the four oven zones was 215° C., 210° C., 205° C., 200° C. After the frame exited the oven, the vacuum was released, the frame was opened, the ink carrier fabric was removed from the decorated object, and the decorated object was removed and inspected.

COMPARATIVE EXAMPLE 1

The sublimation ink carrier media was a knitted polyester fabric having a thickness of 320 microns; a basis weight of 120 g/m$^2$, and a maximum elongation of 125%. The fabric was made using polyester fiber having a dtex of 78. The fabric stretched 7% in the machine direction under a tension of 0.4 N per mm$^2$, and stretched 13.3% in the cross direction under a tension of 0.1 N per mm$^2$. The fabric exhibited the following light transmission porosities: 8.6% porosity at 0% elongation; 13.2% porosity at 20% elongation; 15.2% porosity at 70% elongation.

The molded polyacetal article was decorated by sublimation as described above. The sublimated decoration was blurred and undefined. A photograph of the sublimated decoration is shown in FIG. 1.

Example 2

The sublimation ink carrier media was a woven fabric having a thickness of 586 microns; a basis weight of 216 g/m$^2$, and a maximum elongation of 77%. The woven fabric was a satin fabric of 5 with an offset of 2, and with 23 weft fibers. The fiber used in the machine (warp) direction was a standard type polyester multi-filament fiber having about 200 filaments and a fiber dtex of 167 dtex. The fiber used in the cross (weft) direction was an acetate/spandex fiber obtained from Schwarzenbach of La Tour du Pin, France. The acetate fibers were multi-filament fibers with about 60 filaments and a dtex of 78. The spandex fibers were Lycra® spandex fibers having a dtex of 44, which were wound around the acetate fibers. The fabric stretched 2.4% in the machine direction under a tension of 0.4 N per mm$^2$, and stretched 33.3% in the cross direction of under a tension of 0.1 N per mm$^2$. The fabric exhibited the following light transmission porosities: 0.1% porosity at 0% elongation; 0.6% porosity at 20% elongation; 4.0% porosity at 70% elongation.

Figure 2:
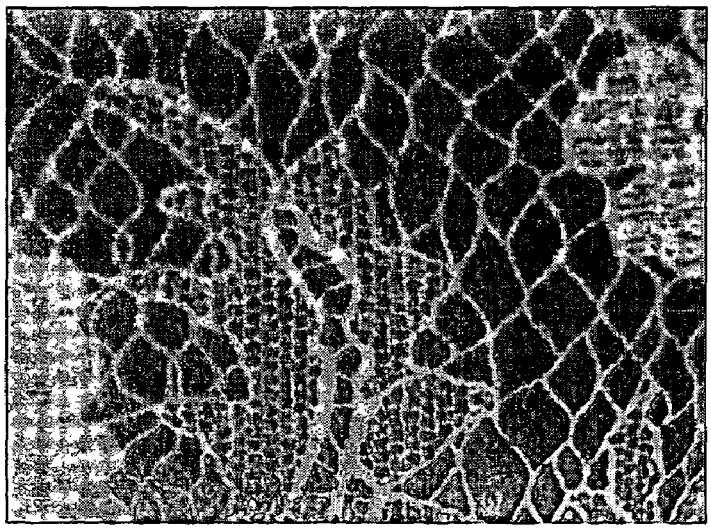
FIG. 2 is a photograph of a sublimated decoration printed with a sublimation ink carrier media according to the invention.

The molded polyacetal article was decorated by sublimation as described above. The sublimated decoration was crisp and very clear. A photograph of the sublimated decoration is shown in FIG. 2.

Although a particular embodiment of the present invention has been described in the foregoing description, it will be understood by those skilled in the art that the invention is capable of numerous modifications, substitutions and rearrangements without departing from the spirit or essential attributes of the invention. Reference should be made to the appended claims, rather than to the foregoing specification and drawings, as indicating the scope of the invention.

It is claimed:

1. A sublimation ink carrier media comprising:

a textile fabric, said fabric having a first direction and a second direction that is substantially perpendicular said first direction, said textile fabric being extensible in said first direction and being substantially non-extensible is said second direction; and a sublimation ink printed on the textile fabric in a pattern.

2. A sublimation ink carrier media according to claim 1 wherein the textile fabric is a woven fabric, said woven fabric having a first set of substantially parallel fibers oriented in said first direction and a second set of substantially parallel fibers oriented in said second direction that is substantially perpendicular said first direction, said first set of fibers being primarily extensible fibers and said second set of fiber being primarily non-extensible fibers.

3. The sublimation ink carrier media of claim 2 wherein the first set of substantially parallel fibers includes elastic fibers.

4. The sublimation ink carrier media of claim 3 wherein the elastic fibers include spandex fibers.

5. The sublimation ink carrier media of claim 2 wherein the elongation of the woven fabric in the first direction of said first set of fibers at a tension of 0.1 N per mm$^2$ is at least 10% and wherein the elongation of the woven fabric in the second direction of said second set of fibers at a tension of 0.3 N per mm$^2$ is less than 5%.

6. The sublimation ink carrier media of claim 2 wherein the elongation of the woven fabric in the first direction of said first set of fibers at a tension of 0.1 N per mm$^2$ is at least 20% and wherein the elongation of the woven fabric in the second direction of said second set of fibers at a tension of 0.3 N per mm$^2$ is less than 3%.

7. The sublimation ink carrier media of claim 2 wherein the elongation of the woven fabric in the first direction of said first set of fibers at a tension of 0.1 N per mm$^2$ is at least 30% and wherein the elongation of the woven fabric in the second direction of said second set of fibers at a tension of 0.3 N per mm$^2$ is less than 3%.

8. The sublimation ink carrier media of claim 2 wherein the first direction of said first set of fibers is the cross direction of the woven fabric and the second direction of said second set of fibers is the machine direction of the woven fabric.

9. The sublimation ink carrier media of claim 2 wherein said woven fabric is a satin.

10. The sublimation ink carrier media of claim 2 wherein the woven fabric has a light transmission porosity at 20% elongation of less than 3%.

11. The sublimation ink carrier media of claim 10 wherein the woven fabric has a light transmission porosity at 20% elongation of less than 1%.

12. The sublimation ink carrier media of claim 2 wherein the fibers are selected from the group of polyester fibers, polyamide fibers, spandex fibers, elastomeric fibers, acetate fibers, viscose fibers, wool fibers, cotton fibers, and cellulose fibers.

13. The sublimation ink carrier media of claim 1 wherein the textile fabric is a nonwoven.

14. The sublimation ink carrier media of claim 13 wherein the elongation of the nonwoven fabric in the first direction of said first set of fibers at a tension of 0.1 N per mm$^2$ is at least 10% and wherein the elongation of the woven fabric in the second direction of said second set of fibers at a tension of 0.3 N per mm$^2$ is less than 5%.

15. A process for the decoration of a shaped article by ink sublimation comprising the steps of:

selecting a textile fabric, said fabric having a first direction and a second direction that is substantially perpendicular said first direction, said textile fabric being extensible in said first direction and being substantially non-extensible is said second direction;

feeding said textile fabric through a printing apparatus in a direction such that the second direction of the textile fabric is substantially parallel to the direction that the textile fabric travels through the printing apparatus;

printing a surface of the textile fabric with one or more sublimation inks in the printing apparatus;

pressing the printed surface of the textile fabric against the surface of the shaped article to be decorated such that the textile fabric is extended and conforms to the surface being decorated; and heating the ink printed on the textile fabric to a temperature sufficient to sublime the ink to a vapor and decorate the shaped article.

16. The process of claim 15 wherein the textile fabric selected is a woven fabric, said woven fabric having a first set of substantially parallel fibers oriented in said first direction and a second set of substantially parallel fibers oriented in said second direction that is substantially perpendicular said first direction, said first set of fibers being primarily extensible fibers and said second set of fiber being primarily non-extensible fibers.

17. The process for the decoration of a shaped article according to claim 16 wherein the first set of substantially parallel fibers includes elastic fibers and the woven fabric is stretched over the surface of the shaped object to be decorated.

18. The process for the decoration of a shaped article according to claim 17 wherein the woven fabric is stretched in the cross direction of the fabric when the fabric is stretched over the surface of the shaped article to be decorated.

19. The process for the decoration of a shaped article according to claim 16 wherein the elongation of the woven fabric in the first direction of said first set of fibers at a tension of 0.1 N per $mm^2$ is at least 10% and wherein the elongation of the woven fabric in the second direction of said second set of fibers at a tension of 0.3 N per $mm^2$ is less than 5%.

20. The process for the decoration of a shaped article according to claim 16 wherein the elongation of the woven fabric in the first direction of said first set of fibers at a tension of 0.1 N per $mm^2$ is at least 20% and wherein the elongation of the woven fabric in the second direction of said second set of fibers at a tension of 0.3 N per $mm^2$ is less than 3%.

21. The process of claim 16 wherein the woven fabric is a satin.

22. The process for the decoration of a shaped article according to claim 15 wherein the textile fabric selected is a non-isotropic nonwoven fabric.

* * * * *